US009266016B2

(12) United States Patent
Matsushita et al.

(10) Patent No.: US 9,266,016 B2
(45) Date of Patent: Feb. 23, 2016

(54) LIGHT SOURCE CONTROL DEVICE AND GAME MACHINE

(75) Inventors: Katsumi Matsushita, Gifu (JP); Yasuyuki Ohba, Aichi (JP); Norihisa Takahashi, San Ramon, CA (US); Hiroyuki Ibuki, Aichi (JP)

(73) Assignee: OMRON Corporation, Kyoto (JP)

( * ) Notice: Subject to any disclaimer, the term of this patent is extended or adjusted under 35 U.S.C. 154(b) by 207 days.

(21) Appl. No.: 14/236,131

(22) PCT Filed: Jun. 22, 2012

(86) PCT No.: PCT/JP2012/066040

§ 371 (c)(1),
(2), (4) Date: Mar. 21, 2014

(87) PCT Pub. No.: WO2013/021740

PCT Pub. Date: Feb. 14, 2013

(65) Prior Publication Data

US 2014/0235339 A1 Aug. 21, 2014

(30) Foreign Application Priority Data

Aug. 10, 2011 (JP) ..... 2011-174953
Aug. 10, 2011 (JP) ..... 2011-175142

(51) Int. Cl.

| | |
|---|---|
| ***G07F 13/00*** | (2006.01) |
| ***A63F 11/00*** | (2006.01) |
| ***G07F 17/32*** | (2006.01) |
| ***H05B 37/02*** | (2006.01) |

(52) U.S. Cl.

CPC ..... *A63F 11/0051* (2013.01); *G07F 17/3202* (2013.01); *H05B 37/02* (2013.01); *A63F 2011/0058* (2013.01)

(58) Field of Classification Search

CPC . A63F 11/0051; G07F 17/3202; H05B 37/02; H05B 33/0857; H05B 33/0863; G02B 27/0994; F21V 23/0442

See application file for complete search history.

(56) References Cited

U.S. PATENT DOCUMENTS

2002/0047646 A1* 4/2002 Lys ..... H05B 33/0857 315/312
2004/0052076 A1* 3/2004 Mueller ..... F21V 23/0442 362/293

FOREIGN PATENT DOCUMENTS

| | | | |
|---|---|---|---|
| JP | H04-96789 | U | 8/1992 |
| JP | 2001-252400 | A | 9/2001 |
| JP | 2003-220235 | A | 8/2003 |
| JP | 2006-218137 | A | 8/2006 |
| JP | 2007-244666 | A | 9/2007 |

(Continued)

OTHER PUBLICATIONS

International Search Report issued in PCT/JP2012/066040 mailed on Jul. 17, 2012 (4 pages).

*Primary Examiner* — Reginald Renwick
(74) *Attorney, Agent, or Firm* — Osha Liang LLP

(57) ABSTRACT

A game machine has a game machine main body, a plurality of light sources arranged on the game machine main body, a light source control device that controls the plurality of light sources, and a rendition control unit that controls a rendition depending on a state of a game. Each of the plurality of light sources has an anode connected to any one of a plurality of first signal lines, a cathode connected to any one of a plurality of second signal lines, and a different combination of the connected first signal lines and the connected second signal lines.

6 Claims, 9 Drawing Sheets

(56) References Cited

FOREIGN PATENT DOCUMENTS

| | | | |
|---|---|---|---|
| JP | 2007-244799 | A | 9/2007 |
| JP | 2010-017383 | A | 1/2010 |
| JP | 2010-188072 | A | 9/2010 |
| JP | 2011-098103 | A | 5/2011 |

* cited by examiner

LIGHT SOURCE CONTROL DEVICE AND GAME MACHINE

BACKGROUND

1. Technical Field

The present invention relates to a light source control device for controlling a plurality of light sources and a game machine having such a light source control device.

2. Related Art

A game machine such as a reel gaming machine or a pinball game machine is devised to perform renditions that appeal to the visual sense, acoustic sense, or feeling of a player so as to improve the interest of the player. In particular, in order to perform a rendition that appeals to the visual sense of a player, the game machine may have a large number of light sources. As the light sources, for example, light-emitting diodes (LED) are used. Red, blue, green LEDs are used in combination with each other to perform a rendition that variously changes emission colors.

In order to improve a dramatic rendition, several hundred LEDs may be arranged on the front surface of the game machine. Depending on renditions, emission luminances or emission periods of the LEDs are adjusted to make it possible to variously change emission states in the front surface of the game machine.

However, with an increase in the number of LEDs mounted on a game machine, the number of lines for driving the LEDs increases, and the number of terminals that are arranged in a processor unit for rendition and output signals for controlling the LEDs also increases. When the number of lines increases, the lines are difficult to be arranged on the rear surface of the game machine, and a processor unit for rendition also increases in cost.

Thus, in order to reduce the number of lines and the number of terminals of the processor unit for rendition, a light source control device arranged between the processor unit for rendition and the LEDs to control emission intensities and emission timings of the LEDs may be mounted on the game machine.

For example, Utility Model Application Publication No. 4-96789 discloses an LED control device in which a serial/parallel conversion circuit receives a serial data signal and an LED control clock from a CPU of a host device and converts the serial data signal into an LED emission signal as a parallel data signal to cause a plurality of LEDs to emit light.

Japanese Unexamined Patent Publication No. 2006-218137 discloses a drive system of a light emitter having a driver IC. The driver IC has a conversion circuit to which a serial data line and a clock data line extended from a controller are cascade-connected to convert a serial signal and a parallel signal from the controller, and a drive circuit that operates a light emitter.

SUMMARY

In the techniques disclosed in Utility Model Application Publication No. 4-96789 and Japanese Unexamined Patent Publication No. 2006-218137, the LEDs are driven by a static lighting method in which a voltage is always applied to the LEDs during lighting. In the static lighting method, since power consumption increases, the number of LEDs that can be driven by an LED control device is limited to about 30 at most.

However, as described above, since several hundred LEDs may be mounted on a game machine, in order to control all the LEDs, 10 or more light source control devices may be consequently required. When a large number of light source control devices are used as described above, the total cost of game machine increases. Since a processor unit for arithmetic operation must control a large number of light source control devices, a control load of the processor unit is disadvantageously large.

A light source control device according to one or more embodiments of the present invention may control more light sources and a game machine having the light source control device.

One or more embodiments of the present invention provides a light source control device that controls a plurality of light sources arranged on a game machine. Each of the plurality of light sources controlled by the light source control device has an anode connected to any one of a plurality of first signal lines, a cathode connected to any one of a plurality of second signal lines, and a different combination of the connected first signal lines and the connected second signal lines. The light source control device includes an interface unit configured to include gradation data that regulates one luminescence amount of the plurality of light sources with a plurality of bits in each of the plurality of light sources and configured to receive a serially transmitted control command, a command analyzing unit configured to generate, for each of a plurality of first signal lines, a first signal for setting a first period being capable of alternately energizing a light source connected to the first signal line in the plurality of light sources in a predetermined cycle, and configured to generate, for each of a plurality of second signal lines, while the first period is set, to the first signal line to which an anode of a light source connected to the second signal line in the plurality of light sources is connected, depending on a luminescence amount represented by the gradation data corresponding to the light source included in the control command, a second signal for setting a second period being capable of energizing the light source, a dynamic control unit configured to apply a voltage to each of the plurality of first signal lines such that a potential in the first period set in the first signal is higher than a potential except in the first period, and a gradation control unit configured to being able to energize, for each of the plurality of second signal lines, in a second period set in the second signal, a light source connected to the second signal line in the plurality of light sources.

In a light source control device according to one or more embodiments of the present invention, the control command includes gradation control data that regulates a bit rate expressing gradation data, the command analyzing unit divides a storage portion for the gradation data in the control command by a bit rate regulated by the gradation control data to extract gradation data for each of the plurality of light sources.

According to one or more embodiments of the present invention, each of the plurality of first signal lines is connected to a discharging signal line, and the gradation control unit, each time a first period is set to any one of the plurality of first signal lines, is capable of energizing the plurality of first signal lines and the discharging signal line in a period shorter than the first period from a rising edge of the first period to discharge residual charges in the plurality of first signal lines.

Furthermore, a light source control device according to one or more embodiments of the present invention has a setting circuit that receives a luminance adjusting signal representing a ratio of an emission intensity of each of the plurality of light sources to the maximum emission intensity to decrease each of the emission intensities of the plurality of light sources depending on the ratio represented by the luminance adjusting signal.

One or more embodiments of the present invention provides a game machine including a game machine main body, a plurality of light sources arranged on the game machine main body, a light source control device configured to control the plurality of light sources, and a rendition control unit configured to control a rendition depending on a state of a game.

In the game machine, each of the plurality of light sources has an anode connected to any one of the plurality of first signal lines, a cathode connected to any one of the plurality of second signal lines, and a different combination of the connected first signal lines and the connected second signal lines.

The rendition control unit, depending on a state of a game, generates a control command including gradation data for regulating one luminescence amount of the plurality of light sources by a plurality of bits in each of the plurality of light sources and serially transmits the control command to the light source control device.

The light source control device includes an interface unit that receives the control command, a command analyzing unit configured to generate, for each of the plurality of first signal lines, a first signal for setting a first period being capable of alternately energizing a light source connected to the first signal line in the plurality of light sources in a predetermined cycle, and configured to generate, for each of a plurality of second signal lines, while the first period is set, to the first signal line to which an anode of the light source connected to the second signal line in the plurality of light sources is connected, depending on a luminescence amount represented by the gradation data corresponding to the light source included in the control command, a second signal for setting a second period being capable of energizing the light source, a dynamic control unit configured to apply a voltage to each of the plurality of first signal lines such that a potential in the first period set in the first signal is higher than a potential except in the first period, and a gradation control unit configured to being able to energize, for each of the plurality of second signal lines, in a second period set in the second signal, a light source connected to the second signal line in the plurality of light sources.

According to one or more embodiments of the present invention, the rendition control unit generates a luminance adjusting signal representing a ratio of an emission intensity of each of the plurality of light sources to the maximum emission intensity and transmits the luminance adjusting signal to the light source control device, and the light source control device further has a setting circuit that receives the luminance adjusting signal to decrease each of the emission intensities of the plurality of light sources depending on the ratio represented by the luminance adjusting signal.

A light source control device and a game machine according to one or more embodiments of the present invention may control more light sources.

DETAILED DESCRIPTION

Embodiments of the present invention will be described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. In a conventional game machine, a large number of LEDs arranged on the game machine may be lighted at the maximum emission intensity or turned off to perform renditions to improve the interest of a player. For this reason, dynamic control in which the maximum emission intensity of the LEDs is lower than that in static control has not been frequently used for LEDs for renditions of a game machine. In particular, in the light source control device for controlling a plurality of light sources, the dynamic control has not been employed. However, the present inventor has knowledge in which the dynamic control can be applied to the light source control device for controlling a plurality of light sources without deteriorating the interest of a player.

The light source control device dynamically controls a plurality of LEDs wired in the form of a matrix to adjust luminescence amounts of the LEDs by a pulse width modulation (PWM) method. For this reason, the light source control device includes gradation data for designating a gradation level in each of LEDs or combinations of LEDs from a host control device, receives a serially transmitted control command, analyzes the control command, and outputs a voltage signal depending on the command in parallel to a signal line connected to the anode side of each of the LEDs and a signal line connected to the cathode side.

Figure 1:
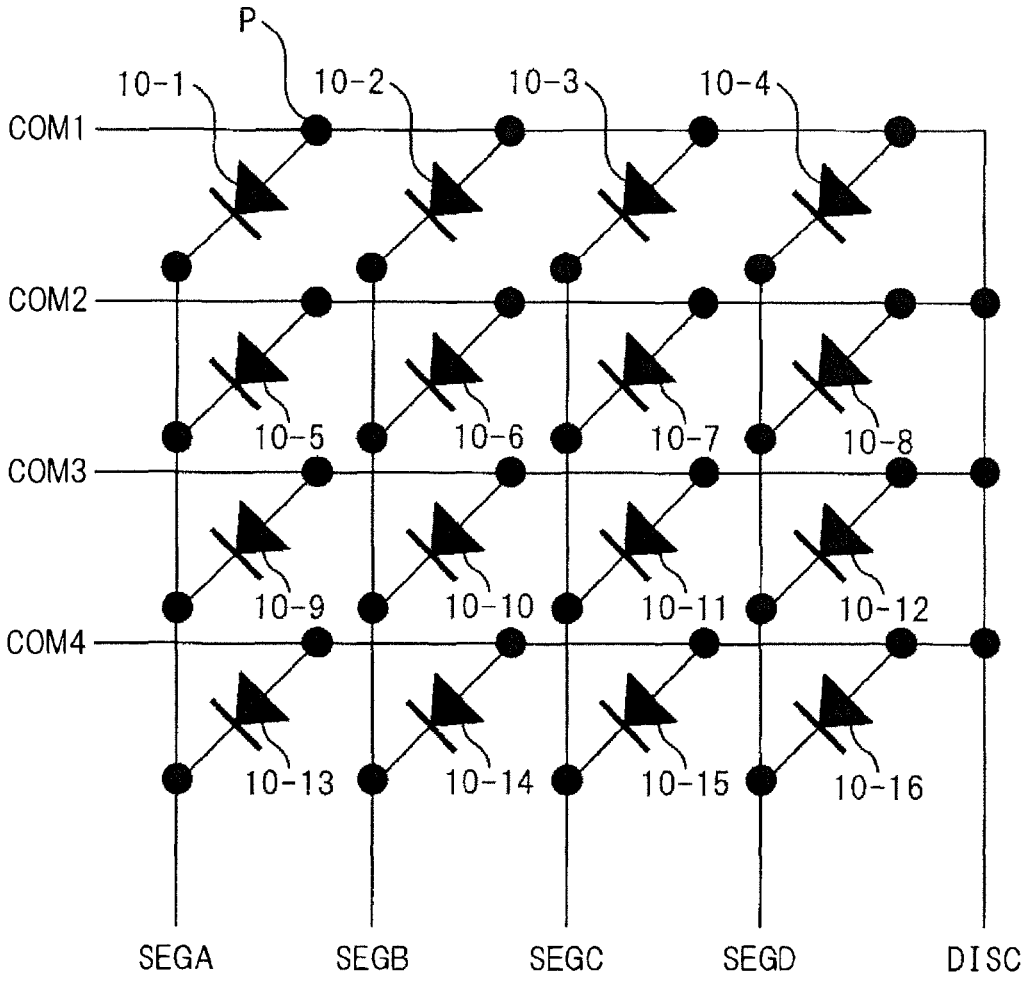
FIG. 1 is a wiring diagram of each LED driven by a light source control device according to one or more embodiments of the present invention.

FIG. 1 is a wiring diagram of each LED driven by a light source control device according to one or more embodiments of the present invention. In this example, LEDs 10-1 to 10-16 serving as light sources are connected to each other in the form of a 4×4 matrix. The anodes of the LEDs 10-1 to 10-4 are connected to a signal line COM1. Similarly, the anodes of the LEDs 10-5 to 10-8 are connected to a signal line COM2. The anodes of the LEDs 10-9 to 10-12 are connected to a signal line COM3. The anodes of the LEDs 10-13 to 10-16 are connected to a signal line COM4. Furthermore, the signal lines COM1 to COM4 are connected to a signal line DISC for discharging.

The cathodes of the LEDs 10-1, 10-5, 10-9, and 10-13 are connected to a signal line SEGA. Similarly, the cathodes of the LEDs 10-2, 10-6, 10-10, and 10-14 are connected to a signal line SEGB. Furthermore, the cathodes of the LEDs

10-3, 10-7, 10-11, and 10-15 are connected to a signal line SEGC. The cathodes of the LEDs 10-4, 10-8, 10-12, and 10-16 are connected to a signal line SEGD.

Each of the signal lines COM1 to COM4, SEGA to SEGD, and DISC is connected to a light source control device according to one or more embodiments of the present invention (will be described later).

Each of the LEDs 10-1 to 10-16 is energized and lighted such that, to make a potential of a signal line to which the cathode of the corresponding LED is connected lower than a potential of a signal line to which the anode of the corresponding LED is connected, a voltage is applied to the signal lines. On the other hand, when the potential of the signal line to which the anode of the LED is connected is equal to the potential of the signal line to which the cathode is connected, or when the potential of the signal line to which the cathode is connected is higher than that of the signal line to which the anode is connected, the LED is not energized and lighted.

Thus, in the light source control device, the potentials of the signal lines COM1 to COM4 and SEGA to SEGD are adjusted to make it possible to light an arbitrary LED of the LEDs 10-1 to 10-16.

Each of the LEDs 10-1 to 10-16 may include a plurality of LEDs connected in series with each other or in parallel to each other. An actual arrangement of the LEDs 10-1 to 10-16 need not be like a matrix, and is determined by positional relationships between members for renditions such as the shape of a game board on which the LEDs are arranged and accessory parts arranged on the game board. Furthermore, the number of signal lines COMy connected to the anode of the LED need not be four. As will be described below, to the signal lines COMy, pulse signals that have high potentials only in a predetermined period and can energize the LEDs connected to the signal lines are alternately applied in a predetermined cycle. For this reason, when the number of signal lines COMy is excessively large, a period in which LEDs can be lighted within a predetermined cycle is short. As a result, since the maximum emission intensity of each of the LEDs decreases, a player feels the LEDs gloomy consequently. Thus, according to one or more embodiments of the present invention, the number of signal lines COMy is eight or less.

The number of signal lines SEGx connected to the cathodes of the LEDs need not be four.

Figure 2:
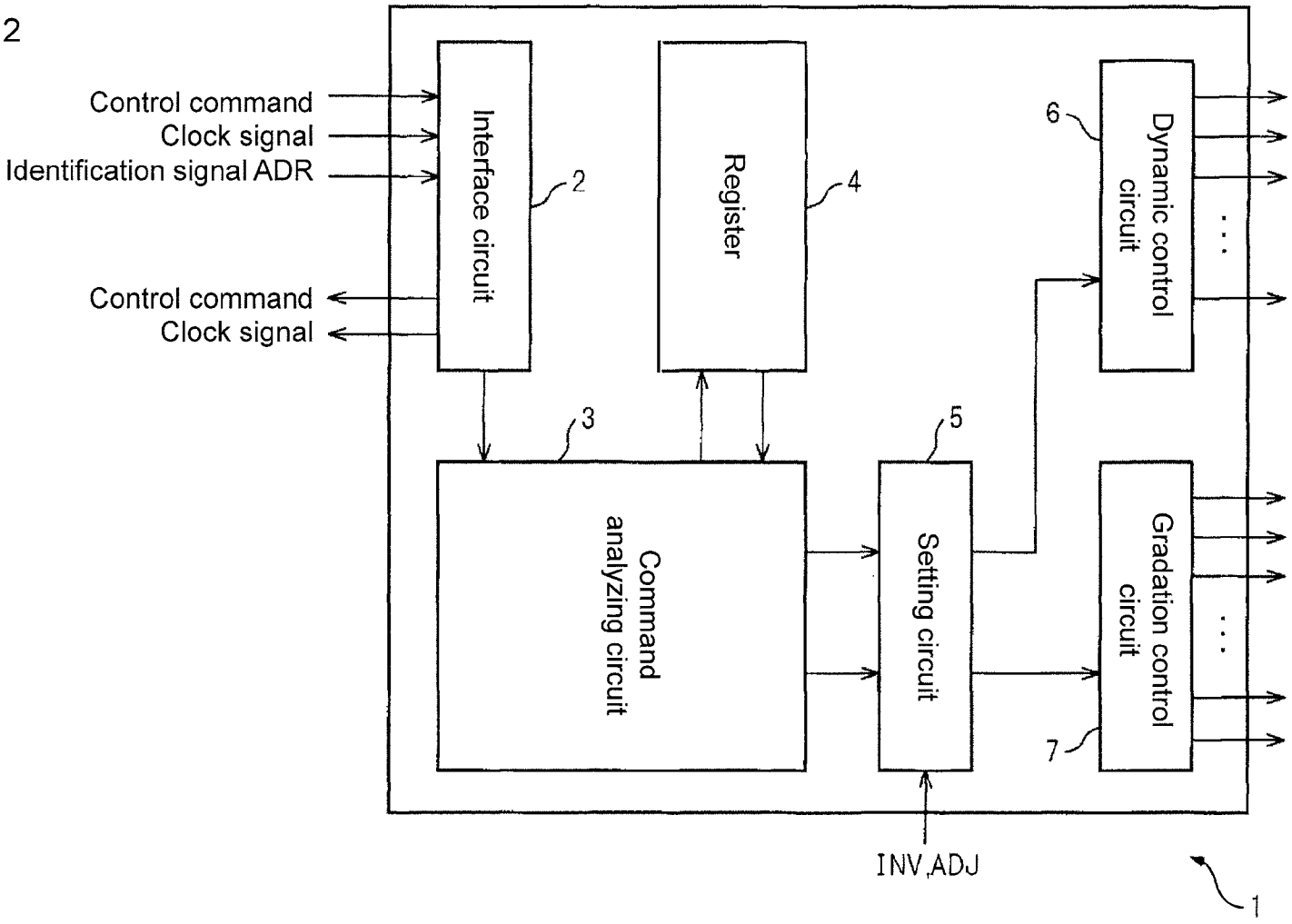
FIG. 2 is a schematic block diagram of the light source control device.

FIG. 2 is a schematic block diagram of a light source control device according to one or more embodiments of the present invention. As shown in FIG. 2, a light source control device 1 includes an interface circuit 2, a command analyzing circuit 3, a register 4, a setting circuit 5, a dynamic control circuit 6, and a gradation control circuit 7.

These components held by the light source control device 1 may be mounted as independent circuits on a circuit board (not shown), or may be mounted on the circuit board as an integrated circuit obtained by integrating the components.

The interface circuit 2 is, for example, an interface circuit to connect a processor unit for rendition (not shown, to be simply referred to as a rendition CPU hereinafter) of a game machine on which the light source control device 1 is mounted and the light source control device 1 to each other. The interface circuit 2 receives, from the rendition CPU, a serially transmitted control command having a plurality of bits and a clock signal for synchronizing each of the plurality of bits included in the control command to analyze the control command. As the clock signal, for example, a signal having a rectangular pulse for each set of a predetermined number of bits in the control command can be used.

The interface circuit 2 receives an identification signal to specify a light source control device to be controlled by the control command from the rendition CPU. The interface circuit 2 gives the control command, the clock signal, and the identification signal to the command analyzing circuit 3.

The interface circuit 2, when the plurality of light source control devices 1 are cascade-connected to each other, transfers the received control command and clock signal to another light source control device of the next stage.

Details of the control command will be described later.

The command analyzing circuit 3 has at least one processor and a peripheral circuit thereof. The command analyzing circuit 3 refers to the clock signal to extract a bit string included in the control command and analyzes the bit string according to the format of the control command to specify a luminescence amount of each of the LEDs.

Figure 3:
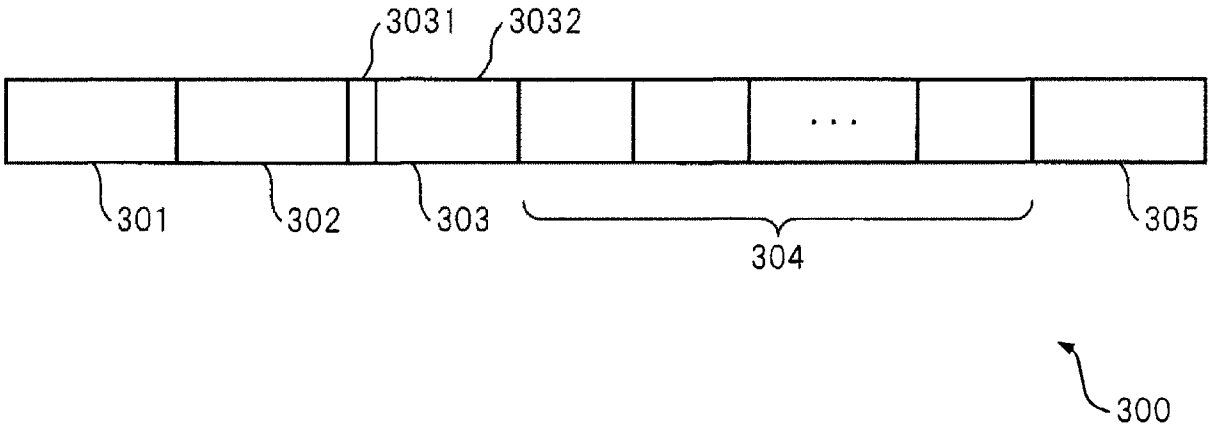
FIG. 3 is a diagram showing an example of a format of a control command.

FIG. 3 is a diagram showing an example of a format of a control command. A control command 300 has a START flag 301, a device address 302, a control data 303, pieces of gradation data 304, and an END flag 305 that are sequentially arranged from the start. Furthermore, the control command 300 may include a 1-bit spacer having a value of, for example, '0' between an adjacent flag, an address, and data.

The START flag 301 is a bit string representing the start of the control command 300. In one or more embodiments of the present invention, a bit string in which 9 bits having a value of '1' are continued is used. The START flag 301 may be a bit string that is not matched with another arbitrary bit string in the control command 300.

The device address 302 is identification information to specify a light source control device to be controlled by the control command 300. In one or more embodiments of the present invention, the device address 302 is expressed by a bit string having a 7-bit length. The command analyzing circuit 3 determines whether the device address 302, as described above, is matched with an identification signal ADR. When the device address 302 is matched with the identification signal ADR, it is determined that the light source control device 1 is to be controlled by the control command 300.

The control data 303 includes a 1-bit gradation control bit 3031 that defines a bit length of each of the pieces of gradation data 304 representing an emission intensity of each of the LEDs controlled by the light source control device 1 and a register address 3032 that regulates a start address of a register in which each piece of the gradation data is stored. When the gradation control bit 3031 is '0', each piece of the gradation data 304 is expressed by 8 bits. On the other hand, when the gradation control bit 3031 is '1', each piece of the gradation data 304 is expressed by 4 bits. When the bit rate of the gradation data is set to be high, the emission intensity of each of the LEDs can be set in detail. On the other hand, when the bit rate of the gradation data is set to be low, the control command becomes short, and a time required for transferring the control command becomes short. For this reason, the emission intensities of the LEDs can be switched in a short cycle. The control command becomes short to reduce a load of the rendition CPU.

The control data 303 may further include the number of the pieces of gradation data for regulating the number of the pieces of gradation data 304 included in the control command. In this manner, when LEDs the number of which is smaller than the maximum number of LEDs that can be simultaneously controlled by the light source control device 1 are connected to the light source control device 1, the control command can be shortened.

Each piece of gradation data 304 represents an emission intensity of an LED connected to the light source control device 1. When the gradation data 304 is expressed by 4 bits, the emission intensity of each of the LEDs is expressed in 16 steps because the gradation data 304 exhibits values of '0' to '15'. On the other hand, when the gradation data 304 is expressed by 8 bits, the emission intensity of each of the LEDs is expressed in 256 steps because the gradation data 304 exhibits values of '0' to '255'. The larger the value of the gradation data 304 is, the higher the emission intensity of a corresponding LED is. For example, when the gradation data 304 is expressed by 4 bits, when the value of the gradation data 304 is '15' (more specifically, all the bits are '1'), the emission intensity of a corresponding LED becomes maximum. On the other hand, when the value of the gradation data 304 is '7', the emission intensity of a corresponding LED becomes ½ of the maximum intensity. When the value of the gradation data 304 is '0', a corresponding LED is turned off. Similarly, when the gradation data 304 is expressed by 8 bits, when the value of the gradation data 304 is '255' (more specifically, all the bits are '1'), the emission intensity of a corresponding LED becomes maximum. On the other hand, when the value of the gradation data 304 is '0', a corresponding LED is turned off.

An order of each piece of gradation data 304 from the start corresponds to positions on the lines of the LEDs connected to the light source control device 1. For example, LEDs corresponding to the gradation data 304 are specified in order of raster scanning. For example, it is assumed that the light source control device 1 can control up to 96 LEDs and that each of the LEDs are connected to any one of the 8 signal lines COMy (y=1 to 8) and any one of the 12 signal lines SEGx (x=1 to 12). In this case, the ith (i=0 to 95) gradation data 304 from the start corresponds to an LED connected to a signal line COM(i/12+1) and a signal line SEG (i %12+1). Note that an operator % is a redundant operator.

An order of the each piece of gradation data 304 from the start may correspond to an alignment of other LEDs.

The END flag 305 is a bit string representing an end of the control command 300. The END flag 305 may be a START flag included in the control command and a bit string that is included in the control command and is not matched with another data bit string.

When the command analyzing circuit 3 receives the control command, for example, the command analyzing circuit 3 detects a bit string matched with a template having the same bit string as that of the START flag in the control command, and sets the bit string as the START flag. The command analyzing circuit 3 extracts a device address from the control command according to the format of the control command.

The command analyzing circuit 3 discards the control command when the device address is not matched with identification information ADR. On the other hand, when the device address is matched with the identification information ADR, the command analyzing circuit 3 extracts control data from the control command according to the format of the control command, and checks a bit length of each piece of gradation data with reference to a gradation control bit included in the control command. The command analyzing circuit 3 divides a portion, in which gradation data is stored, in the control command by a bit rate regulated by a gradation control bit to extract each piece of gradation data and stores the gradation data in the register 4.

Furthermore, the command analyzing circuit 3, depending on each piece of the gradation data, generates a signal representing a voltage applied to each of the signal lines COMy and SEGx.

In one or more embodiments of the present invention, the light source control device 1 dynamically controls each of the LEDs to set the emission intensity of each of the LEDs according to the PWM method. More specifically, the light source control device 1 sequentially outputs cyclical pulse signals to each of the signal lines COMy in a predetermined cycle (for example, 1 msec) to set an LED connected to the signal line to a high potential at which the LED can be turned on and to set the LED to a low potential at which the LED is not turned on in the other periods. On the other hand, to each of the signal lines SEGx, the light source control device 1 outputs a pulse signal, in a period in which a pulse is applied to the signal line COMy to which the anode of an LED having a cathode connected to the signal line is connected, to set the LED to a low potential in only a period corresponding to an emission intensity represented by gradation data corresponding to the LED and to set the LED to a high potential in the other periods.

Figure 4:
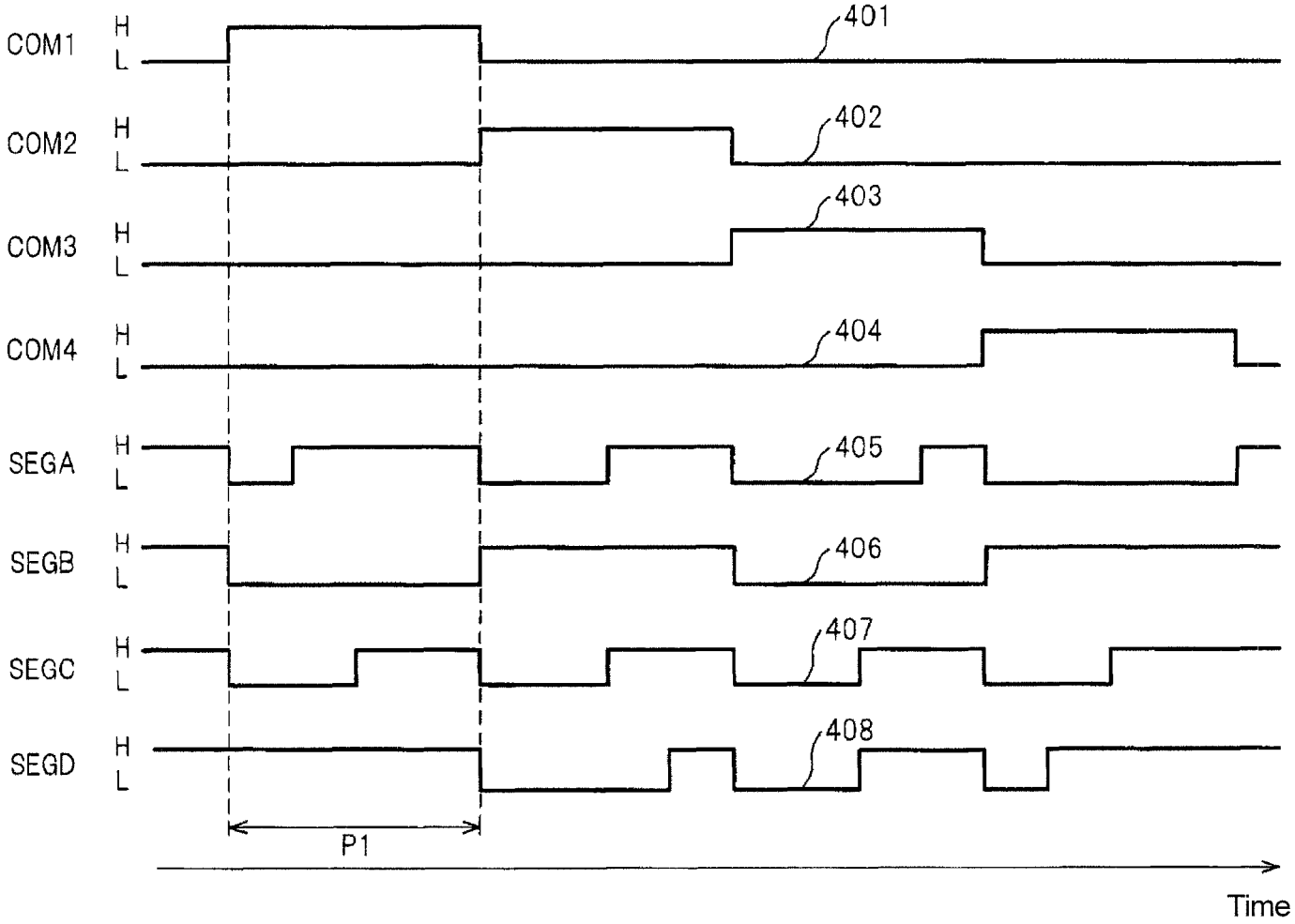
FIG. 4 is a timing chart showing an example of a time-change in voltage applied to each signal line shown in FIG. 1.

FIG. 4 is a timing chart showing an example of a time-change in voltage applied to each signal line shown in FIG. 1.

In FIG. 4, waveforms 401 to 404 represent signal waveforms applied to the signal lines COM1 to COM4, respectively, and waveforms 405 to 408 represent signal waveforms applied to signal lines SEGA to SEGD, respectively. An abscissa for the signal waveforms represents time. An ordinate represents potentials applied to the signal lines, H represents a high potential, and L represents a low potential.

As shown in the signal waveforms 401 to 404, to only any one of the signal lines COM1 to COM4, a pulse having a high potential is sequentially alternately applied to the signal lines COM1 to COM4. The width of the pulse is, for example, 1 msec. Thus, in this case, 4 msec are set as one cycle, and a pulse is applied to all the signal lines COM1 to COM4 once a cycle.

On the other hand, as shown in the signal waveforms 405 to 408, in relation to the signal lines SEGA to SEGD, in a period in which high-potential pulses are applied to signal lines COMy (y=1, 2, 3, and 4), by the PWM control, the pulses have low potentials in only a period corresponding to the emission intensities of the LEDs connected to the signal lines COMy and the signal lines SEGA to SEGD. For example, in a period P1 in which a pulse is applied to the signal line COM1, the signal line SEGA has a low potential in only a period that is ¼ the period P1. Thus, the emission intensity of the LED 10-1 connected to the signal lines COM1 and SEGA is ¼ of the maximum emission intensity. Similarly, in the period P1, the signal lines SEGB and SEGC have low potentials in the same period as the period P1 and a period that is ½ of the period P1, respectively. For this reason, the emission intensity of the LED 10-5 connected to the signal lines COM1 and SEGB becomes the maximum emission intensity, and the emission intensity of the LED 10-9 connected to the signal lines COM1 and SEGC becomes ½ of the maximum signal intensity. In the period P1, the signal line SEGD always has a high potential. Thus, the LED 10-13 connected to the signal lines COM1 and SEGD does not emit light.

Immediately after the period in which a pulse is applied to the signal line COMy is ended, a time lag occurs until all electric charges accumulated in the signal line are discharged. While the electric charges remain in the signal lines, an LED connected to the signal line may be erroneously turned on.

Figure 5:
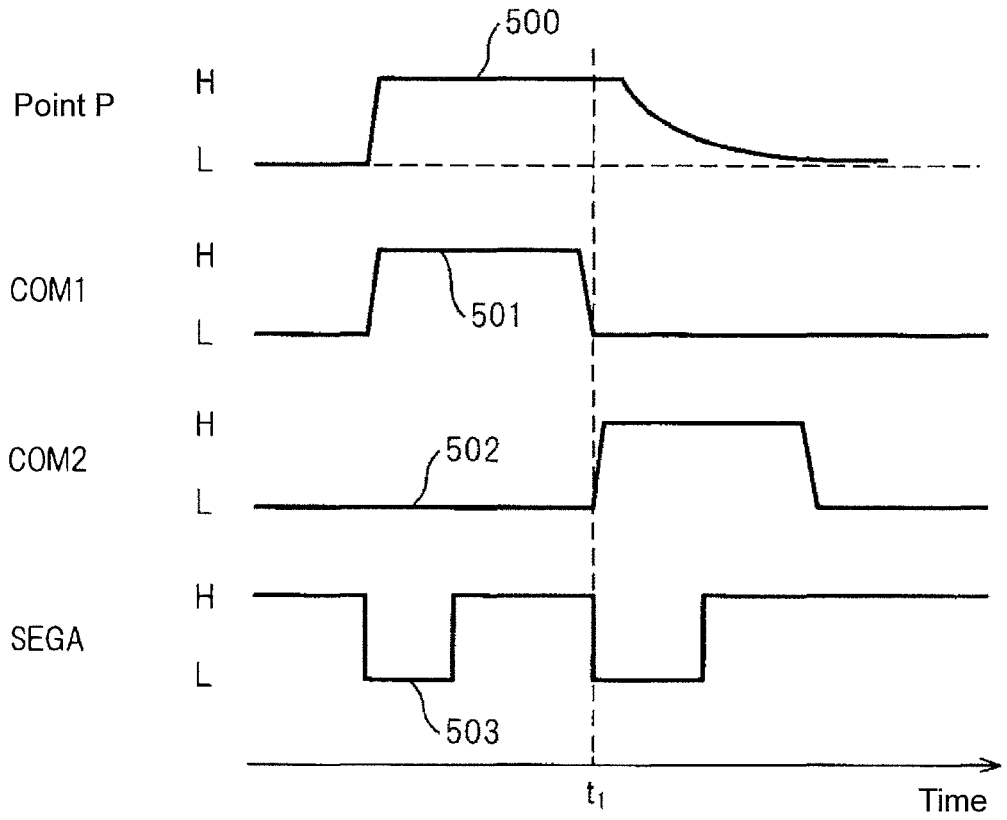
FIG. 5 is a graph showing, when an LED is erroneously turned on, a time-change in voltage of a signal line related to the LED.

A principle of erroneous lighting caused by residual electric charges will be described with reference to FIG. 5. In FIG. 5, an abscissa represents time. A waveform 500 represents a potential at a point P in FIG. 1. The waveforms 501 and 502 represent waveforms of signals applied to the signal lines COM1 and COM2, respectively. The waveform 503 represents a waveform of a signal applied to the signal line SEGA.

As shown in the waveforms 501 and 502, a period in which a pulse applied to the signal line COM1 at time $t_1$ is applied is ended, and a period in which a pulse is applied to the signal line COM2 is started. However, as shown in the waveform 500, at the point P, due to the residual electric charges, even after time the potential does not immediately decrease and gradually decreases when the residual electric charges are discharged. In this case, when the potential of the signal line SEGA is decreased immediately after time $t_1$ to light the LED 10-5 connected to the signal lines COM2 and SEGA, a voltage between the potential of the signal line COM1 and the signal line SEGA is higher than a minimum voltage at which the LED 10-1 is turned on. As a result, in a period in which the residual electric charges of the signal line COM1 are sufficiently discharged immediately after time $t_1$, the LED 10-1 is erroneously turned on.

Thus, the light source control device 1, in only a predetermined discharging period immediately after the signal lines to which a pulse is applied is switched, makes the signal lines and a discharging signal line DISC energizable to discharge the residual electric charges from the signal lines COMy. Thereafter, the light source control device 1 decreases the potentials of the signal lines SEGx to make it possible to prevent the LEDs from being erroneously turned on.

Figure 6:
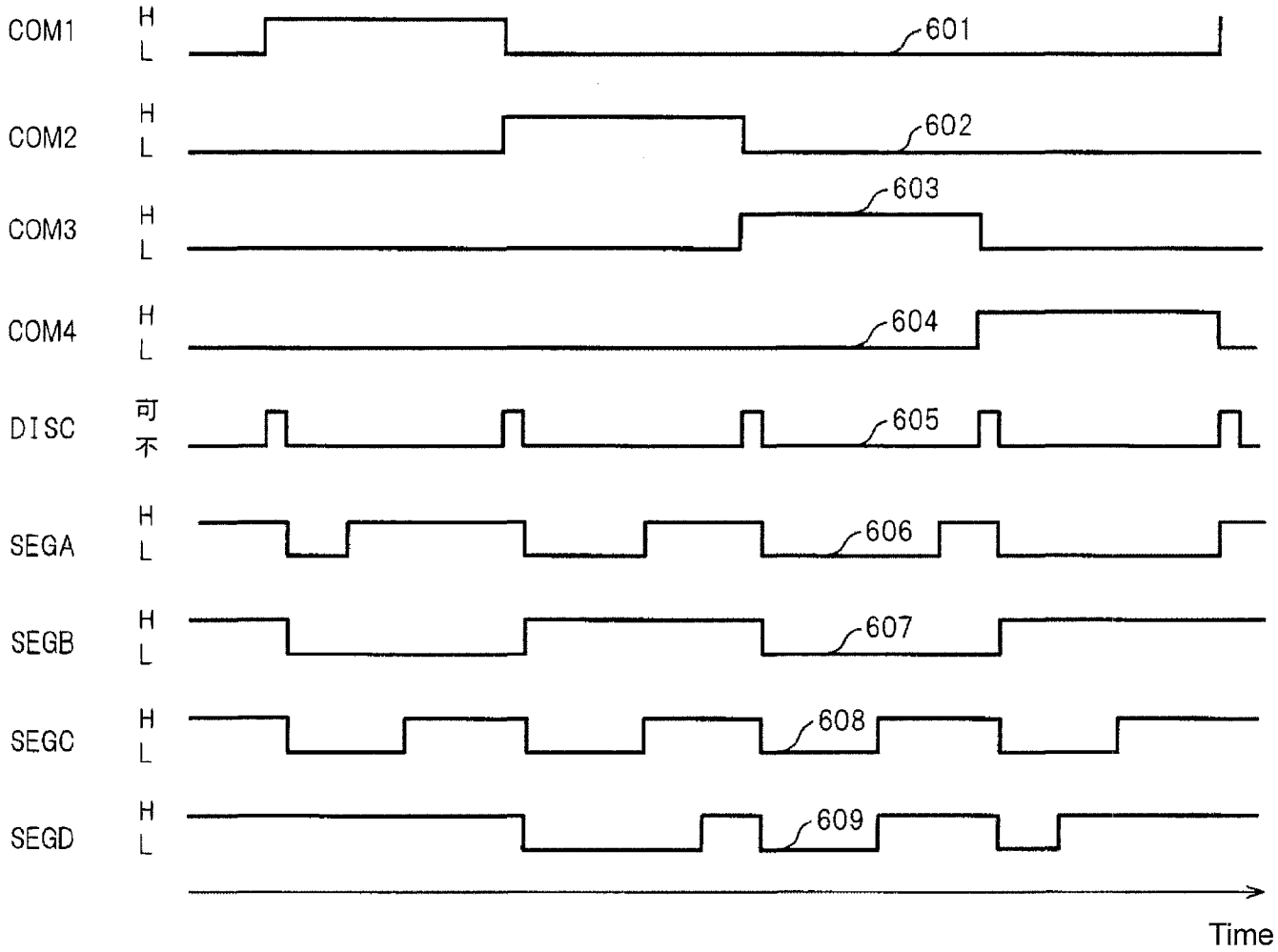
FIG. 6 is a timing chart showing another example of a time-change in voltage applied to each signal line shown in FIG. 1.

FIG. 6 is a timing chart showing another example of a time-change in voltage applied to each signal line shown in FIG. 1.

In FIG. 6, waveforms 601 to 604 represent signal waveforms applied to the signal lines COM1 to COM4, respectively. A waveform 605 represents time changes of a period in which the discharging signal line DISC can be energized and a period in which the discharging signal line DISC cannot be energized. Waveforms 606 to 609 represent signal waveforms applied to the signal lines SEGA to SEGD, respectively. An abscissa for the signal waveforms 601 to 604 and 606 to 609 represents time. An ordinate represents potentials applied to the signal lines, H represents a high potential, and L represents a low potential. Furthermore, in relation to the waveform 605, the abscissa represents time, 'able' on the ordinate represents energizable, and 'disable" represents non-energizable.

As shown in the signal waveform 605, the pulses applied to the signal lines COM1 to COM4 rise, and at the same time, the discharging signal line DISC is set to be energizable. In a predetermined discharging period, the discharging signal line DISC is kept energizable. After the discharging period has elapsed, the potentials of the signal lines SEGA to SEGD connected to the lighted LED are decreased.

The discharging period is set to the minimum value, for example, 20 μsec in a period in which the residual electric charges of the signal lines COMy are discharged not to erroneously turn on the LED.

In one or more embodiments of the present invention, in the discharging period, since the LED cannot be turned on, the maximum luminescence amount of the LED decreases by a ratio of the discharging period to a time length of the pulse applied to the signal lines COMy. However, since the discharging period is about several percent of the time length of the pulse, a decreasing rate of the maximum luminescence amount is about several % at most.

A discharge setting flag representing whether the discharging period is set may be included in the control data of the control command. In this case, the command analyzing circuit 3 may switch whether to set the discharging period with reference to the value of the discharge setting flag. For example, when the discharge setting flag is set to a value (for example, '1') representing that the discharging period is set, the command analyzing circuit 3, as shown in FIG. 6, sets the discharging period started simultaneously with the rising edge of the pulse applied to the signal lines COMy. In the discharging period, the command analyzing circuit 3 makes the discharging signal line DISC energizable.

On the other hand, when the discharge setting flag is set to a value (for example, '0') representing that the discharging period is not set, the command analyzing circuit 3, as shown in FIG. 4, determines signal waveforms to the signal lines without setting the discharging period.

The command analyzing circuit 3, for example, sets, to each of the signal lines COMy, a pulse that can alternately energize an LED connected to the signal line in a predetermined cycle, and generates a signal having a first potential in the period in which pulses are applied in units of signal lines COMy and having a second potential different from the first potential in a period in which the pulses are not applied. The command analyzing circuit 3 outputs signals corresponding to the signal lines COMy to the dynamic control circuit 6 in parallel through the setting circuit 5.

The command analyzing circuit 3, in relation to each of the signal lines SEGx, sets a period in which the LED can be energized, depending on a luminescence amount represented by gradation data corresponding to the LED and included in a control command, within a period in which a pulse is applied to the signal line COMy to which the anode of an LED connected to the signal line in the LEDs 10-1 to 10-16 is connected. The command analyzing circuit 3, in relation to each of the signal lines SEGx and the discharging signal line DISC, generates a signal having a first potential in a period in which an LED can be energized and having a second potential in a period in which the LED cannot be energized, the second potential being different from the first potential. The command analyzing circuit 3 outputs signals corresponding to the signal lines SEGx and the discharging signal line DISC to the gradation control circuit 7 in parallel through the setting circuit 5.

The register 4 has, for example, a volatile programmable semiconductor memory circuit. The register 4 stores gradation data of each LED included in a control command received by the light source control device 1. The register 4 holds gradation data included in the previous control command until the command analyzing circuit 3 receives a new control command and updates the gradation data included in the previous control command with gradation data included in the new control command.

The command analyzing circuit 3 specifies the luminescence amount of each of the LEDs according to the gradation data stored in the register 4 until the command analyzing circuit 3 receives the new control command. Thus, an emission pattern of the LEDs controlled by the light source control device 1 is maintained to an emission pattern regulated by the previous control command until the light source control device 1 receives a new control command.

The setting circuit 5 receives a setting signal for designating a common setting of the signal lines from a rendition CPU and adjusts signals output from the signal lines depending on the setting signal. For example, when the setting circuit 5 receives an inversion signal INV serving as one of setting signals from the rendition CPU, the setting circuit 5 inverts a signal value output from the command analyzing circuit 3 to the gradation control circuit 7. More specifically, in a period in which a signal having the first potential is output from the command analyzing circuit 3 to one of the signal lines SEGx, the gradation control circuit 7 makes an LED connected to the signal line SEGx non-energizable. On the other hand, in a period in which a signal having the second potential is output from the command analyzing circuit 3, the gradation control circuit 7 makes the LED connected to the signal line SEGx energizable.

When the setting circuit 5 receives a luminance adjusting signal ADJ that is another one of the setting signals and represents a ratio of the emission intensity of the LED to the maximum emission intensity from the rendition CPU, the setting circuit 5 adjusts a period in which a pulse is applied to each of the signal lines COMy depending on the ratio. For this reason, the setting circuit 5 shortens a period in which a signal having the first potential on each of the signal lines COMy is output from the command analyzing circuit 3 to the dynamic control circuit 6 depending on the ratio. In this manner, the light source control device 1, for example, when the game machine is in a standby state (more specifically, when there is no player who plays the game machine), can uniformly decrease the emission intensities of all the LEDs depending on the ratio while an emission pattern itself of the LEDs is set to a pattern corresponding to a rendition. For this reason, the light source control device 1 can reduce a control command of the rendition CPU. Furthermore, for example, when a game machine on which the light source control device 1 is mounted is in a standby state or the like, by using the luminance adjusting signal ADJ, the emission intensities of all the LEDs are uniformly decreased to cause the light source control device 1 to be able to suppress power consumption of the game machine.

The dynamic control circuit 6 is connected to the signal lines COMy and has, for example, switching elements (not shown) such as transistors in units of signal lines. For example, in units of signal lines COMy, signals about the signal lines received from the command analyzing circuit 3 are input to the switching elements. While the signal has the first potential, the switching element electrically connects the corresponding signal line COMy to a power supply (not shown). On the other hand, when the signal has the second potential, the switching element does not electrically connect the corresponding signal line COMy to the power supply. In this manner, the dynamic control circuit 6 outputs a voltage signal having a waveform corresponding to the signal received from the command analyzing circuit 3 to each of the signal lines COMy.

The gradation control circuit 7 are connected to the signal lines SEGx and the discharging signal line DISC and has switching elements (not shown) such as transistors on the signal lines SEGx. For example, in units of signal lines SEGx and discharging signal line DISC, signals about the signal lines received from the command analyzing circuit 3 are input to the switching elements. While the signal has the first potential, the switching element grounds the corresponding signal line SEGx or DISC. On the other hand, while the signal has the second potential, the switching element does not ground the corresponding signal line SEGx or DISC. In this manner, the gradation control circuit 7 makes the signal lines SEGx and DISC energizable in only a period regulated by a signal received from the command analyzing circuit 3.

As described above, since the light source control device controls the lighting timings and emission intensities of the LED by dynamic control using the PWM method, the light source control device suppress power consumption of each of the LEDs. As a result, the light source control device can control a larger number of LEDs. For this reason, by using the light source control device, the number of light source control devices to be mounted on a game machine can be reduced.

The present invention is not limited to the above embodiments. For example, a light source controlled by the light source control device need not be an LED. As the light source, a light source the emission intensity of which can be controlled by the PWM method may be used.

A function of the setting circuit may be executed by a processor included in a command analyzing circuit. In this case, the command analyzing circuit corrects signals to the signal lines COMy, SEGx, and DISC based on a setting signal received from the rendition CPU and then outputs the corrected signals to a dynamic control circuit and a gradation control circuit.

According to another modification, the light source control device may further include a constant current circuit to adjust an amount of current flowing in each of the LEDs depending on a ratio regulated by the luminance adjusting signal ADJ.

Figure 7:
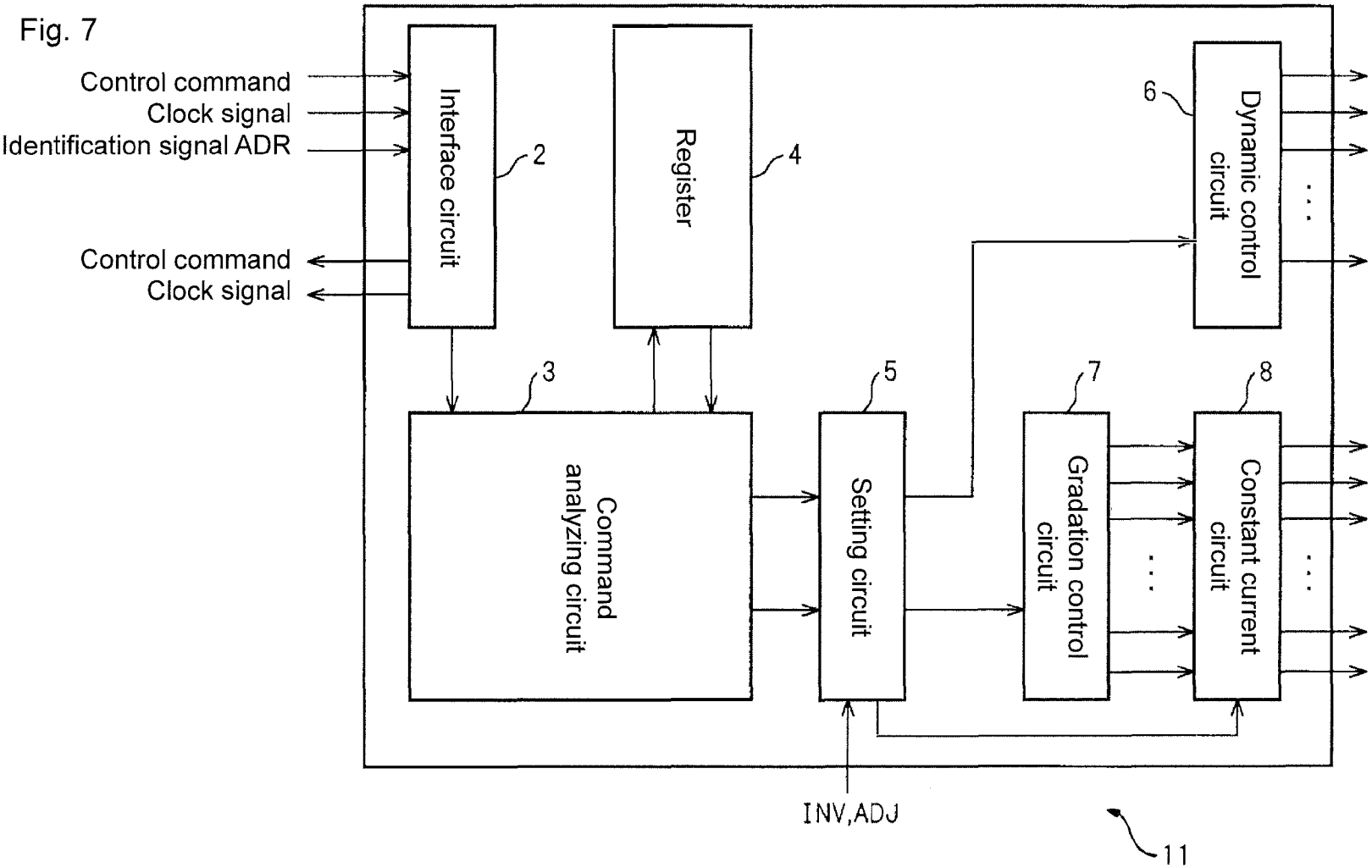
FIG. 7 is a schematic block diagram of a light source control device according to a modification.

FIG. 7 is a schematic block diagram of a light source control device 11 according to the modification. The light source control device 11 includes the interface circuit 2, the command analyzing circuit 3, the register 4, the setting circuit 5, the dynamic control circuit 6, the gradation control circuit 7, and a constant current circuit 8. The light source control device 11 according to the modification is different from the light source control device 1 shown in FIG. 2 in having the constant current circuit 8. Thus, the constant current circuit 8 and related parts thereof will be described below.

The constant current circuit 8, for example, has a variable resistor connected between each of the signal lines SEGx and the gradation control circuit 7. In this modification, when the setting circuit 5 receives the luminance adjusting signal ADJ, the setting circuit 5 adjusts a resistance of each of the variable resistors included in the constant current circuit 8 in place of adjustment of a period in which a pulse is applied to each of the signal lines COMy such that the emission luminance of each of the LEDs decreases by a ratio regulated by the luminance adjusting signal ADJ received by the setting circuit 5. In this manner, the light source control device 11 can uniformly adjust the luminescence amounts of the LEDs.

In still another modification, the constant current circuit 8 may have a variable resistor connected between each of the signal lines COMy and the dynamic control circuit 6. In this case, the resistance of each of the variable resistors is adjusted such that the emission luminance of each of the LEDs decreases by a ratio regulated by the luminance adjusting signal ADJ received by the setting circuit 5, so that the light source control device can uniformly adjust the luminescence amounts of the LEDs.

The light source control devices according to one or more embodiments of the present invention may be mounted on a game machine such as a pinball game machine or a reel gaming machine.

Figure 8:
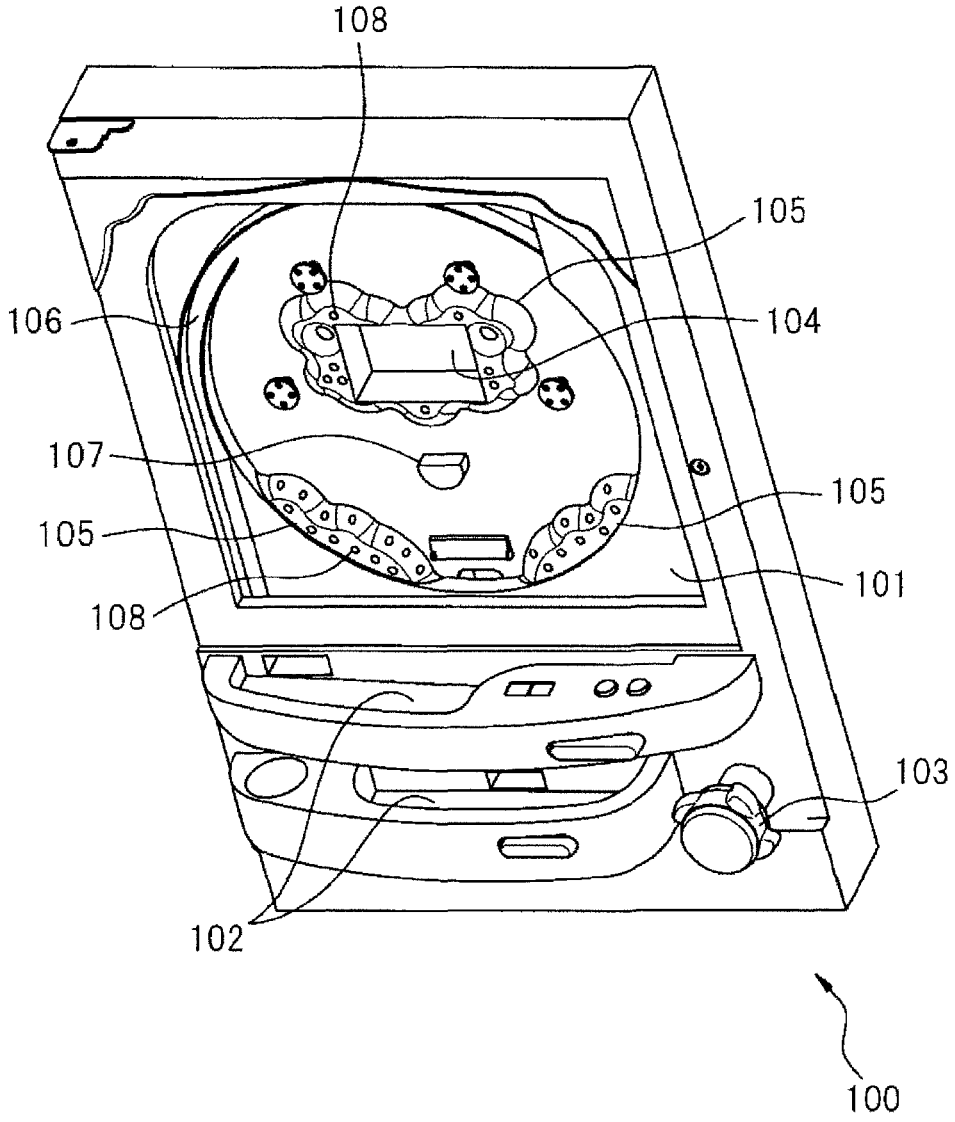
FIG. 8 is a schematic perspective view of a pinball game machine including a light source control device according to one or more embodiments of the present invention.
Figure 9:
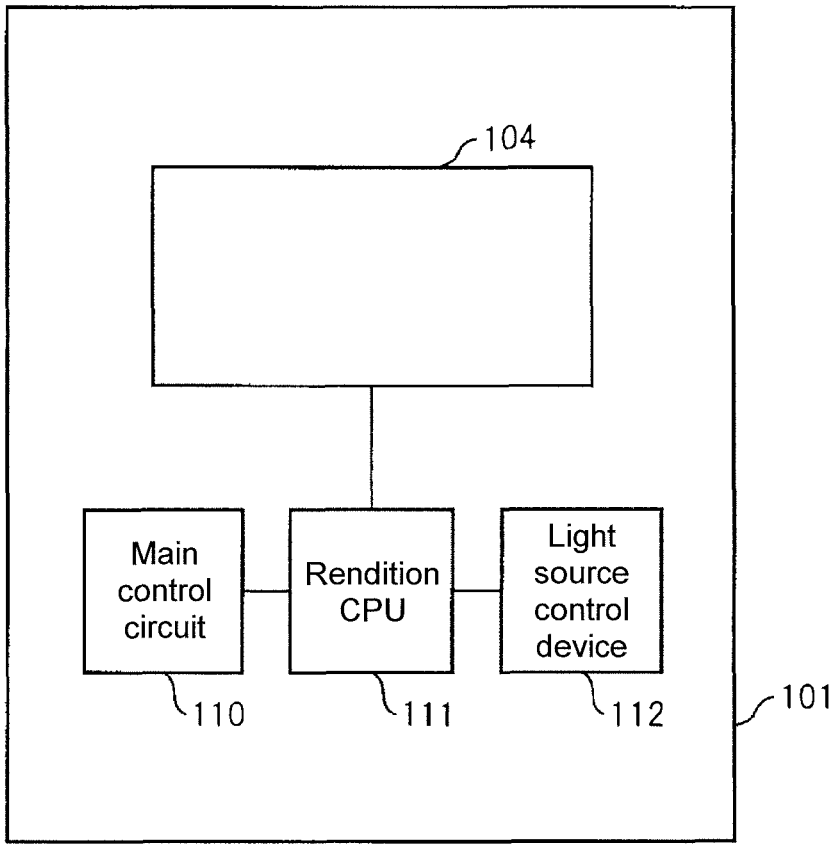
FIG. 9 is a schematic rear view of a pinball game machine including a light source control device according to one or more embodiments of the present invention.

FIG. 8 is a schematic perspective view of a pinball game machine 100 including the light source control device according to one or more embodiments of the present invention. FIG. 9 is a schematic rear view of the pinball game machine 100. As shown in FIG. 8, the pinball game machine 100 has a game board 101 arranged in a large part of an area extending from an upper portion to a middle portion and serving as a game machine main body, a ball receiving unit 102 arranged at a lower side of the game board 101, an operation unit 103 having a handle, a display device 104 arranged at almost the center of the game board 101, and accessory parts 105 arranged around the display device 104 and at the lower side of the game board 101 on the front surface of the game board 101 and used in a rendition of the game. A rail 106 is arranged on the side of the game board 101. On the game board 101, a large number of obstacle pins (not shown) and at least one winning device 107 are arranged.

The operation unit 103 shoots a game ball with a predetermined force by using a shooting device (not shown) depending on a turning angle of the handle by an operation of a player. The shot game ball moves upward along the rail 106 and drops between the large number of obstacle pins. When a sensor (not shown) detects that a game ball enters any one of the winning devices 107, a main control circuit 110 arranged on the rear surface of the game board 101 delivers a predetermined number of game balls depending on the winning device 107 which the game ball enters to the ball receiving unit 102 through a ball delivery device (not shown). Furthermore, the main control circuit 110 displays various videos on the display device 104 through a rendition CPU 111 arranged on the rear surface of the game board 101.

On the accessory part 105, a plurality of LEDs 108 are arranged, and the LEDs 108 are controlled by a light source control device 112 arranged on the rear surface of the game board 101. As the light source control device 112, a light source control device according to one or more embodiments of the present invention can be used. The LEDs may be arranged on the front surface of the game board 101 or around the game board 101 except on the accessory parts 105.

Based on a state signal representing a state of a game transmitted from the main control circuit 110 to the rendition CPU 111, the rendition CPU 111 determines LEDs to be lighted of the LEDs 108 and the emission intensities of the LEDs to be lighted and generates a control command according to the determination. The rendition CPU 111 outputs the generated control command to the light source control device 112. For example, before a game ball enters the winning device 107, the rendition CPU 111 sets a gradation control bit included in control data of the control command to '1' and roughly sets the emission intensity of each of the LEDs. On the other hand, when it is detected that a game ball enters the winning device 107 to input a state signal representing that the game ball enters the winning device 107 from the main control circuit 110 to the rendition CPU 111, the rendition CPU 111 sets a gradation control bit to '0' to determine the emission intensity of each of the LEDs in detail. The rendition CPU 111, when the pinball game machine 100 is in a standby state, generates, for example, the luminance adjusting signal ADJ for setting a ratio of luminance to 50% to decrease the emission luminance of each of the LEDs 108, and outputs the luminance adjusting signal ADJ to the light source control device 112.

The light source control device 112 flickers the LEDs at predetermined emission intensities according to the control command and the luminance adjusting signal ADJ.

In this manner, a person skilled in the art can effect various changes in accordance with embodiments within the scope of the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

1, 11 light source control device
2 interface circuit
3 command analyzing circuit
4 register
5 setting circuit
6 dynamic control circuit
7 gradation control circuit
8 constant current circuit
10-1 to 10-16 LED
COM1 to COM4, SEGA to SEGD signal line
100 pinball game machine
101 game board
102 ball receiving unit
103 operation unit
104 display device
105 accessory part
106 rail
107 winning device
108 decorating device
110 main control circuit
111 rendition CPU
112 light source control device

The invention claimed is:

1. A light source control device configured to control a plurality of light sources arranged on a game machine, each of the plurality of light sources comprising an anode connected to any one of a plurality of first signal lines, a cathode connected to any one of a plurality of second signal lines, and a different combination of the connected first signal lines and the connected second signal lines, the light source control device comprising:

an interface unit that includes gradation data that regulates one luminescence amount of the plurality of light sources with a plurality of bits in each of the plurality of light sources and receives a serially transmitted control command;

a command analyzing unit that:

generates, for each of the plurality of first signal lines, a first signal for setting a first period being capable of alternately energizing a light source connected to the first signal line in the plurality of light sources in a predetermined cycle, and generates, for each of the plurality of second signal lines, while the first period is set, a second signal for setting a second period being capable of energizing the light source to the first signal line to which an anode of a light source connected to the second signal line in the plurality of light sources is connected, depending on a luminescence amount represented by the gradation data corresponding to the light source included in the control command;

a dynamic control unit that applies a voltage to each of the plurality of first signal lines such that a potential in the first period set in the first signal is higher than a potential except in the first period; and a gradation control unit that energizes a light source connected to the second signal line in the plurality of light sources, for each of the plurality of second signal lines, in the second period set in the second signal.

2. The light source control device according to claim 1, wherein the control command includes gradation control data that regulates a bit length expressing gradation data, and wherein the command analyzing unit divides a storage portion for the gradation data in the control command by a bit length regulated by the gradation control data to extract the gradation data for each of the plurality of light sources.

3. The light source control device according to claim 1, wherein each of the plurality of first signal lines is connected to a discharging signal line, and wherein, each time the first period is set to any one of the plurality of first signal lines, the gradation control unit energizes the plurality of first signal lines and the discharging signal line in a period shorter than the first period from a rising edge of the first period to discharge residual charges in the plurality of first signal lines.

4. The light source control device according to claim 1, further comprising:

a setting circuit that receives a luminance adjusting signal representing a ratio of an emission intensity of each of the plurality of light sources to the maximum emission intensity to decrease each of the emission intensities of the plurality of light sources depending on the ratio represented by the luminance adjusting signal.

5. A game machine comprising:

a game machine main body;

a plurality of light sources arranged on the game machine main body;

a light source control device that controls the plurality of light sources; and a rendition control unit that controls a rendition depending on a state of a game, wherein each of the plurality of light sources comprises:

an anode connected to any one of a plurality of first signal lines, a cathode connected to any one of a plurality of second signal lines, and a different combination of the connected first signal lines and the connected second signal lines, wherein, depending on the state of game, the rendition control unit generates a control command including gradation data for regulating one luminescence amount of the plurality of light sources with a plurality of bits in each of the plurality of light sources and serially transmits the control command to the light source control device, and wherein the light source control device comprises:

an interface unit that receives the control command, a command analyzing unit that:

generates, for each of the plurality of first signal lines, a first signal for setting a first period being capable of alternately energizing a light source connected to the first signal line in the plurality of light sources in a predetermined cycle, and generates, for each of the plurality of second signal lines, while the first period is set, a second signal for setting a second period being capable of energizing the light source to the first signal line to which an anode of a light source connected to the second signal line in the plurality of light sources is connected, depending on a luminescence amount represented by the gradation data corresponding to the light source included in the control command, a dynamic control unit that applies a voltage to each of the plurality of first signal lines such that a potential in the first period set in the first signal is higher than a potential except in the first period, and a gradation control unit that energizes a light source connected to the second signal line in the plurality of light sources, for each of the plurality of second signal lines, in the second period set in the second signal.

6. The game machine according to claim 5, wherein the rendition control unit generates a luminance adjusting signal representing a ratio of an emission intensity of each of the plurality of light sources to the maximum emission intensity and transmits the luminance adjusting signal to the light source control device, and wherein the light source control device further comprises a setting circuit that receives the luminance adjusting signal to decrease each of the emission intensities of the plurality of light sources depending on the ratio represented by the luminance adjusting signal.

* * * * *